US008942352B2

(12) United States Patent
Jeong et al.

(10) Patent No.: US 8,942,352 B2
(45) Date of Patent: Jan. 27, 2015

(54) FIELD EMISSION X-RAY TUBE APPARATUS FOR FACILITATING CATHODE REPLACEMENT

(75) Inventors: Jin Woo Jeong, Daejeon (KR); Jun Tae Kang, Daegu (KR); Yoon Ho Song, Daejeon (KR); Jae Woo Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 289 days.

(21) Appl. No.: 13/406,545

(22) Filed: Feb. 28, 2012

(65) Prior Publication Data

US 2012/0250827 A1 Oct. 4, 2012

(30) Foreign Application Priority Data

Mar. 29, 2011 (KR) ..... 10-2011-0027942

(51) Int. Cl.

| | |
|---|---|
| ***H01J 35/16*** | (2006.01) |
| ***H01J 35/06*** | (2006.01) |
| ***G21G 4/08*** | (2006.01) |
| ***H01J 35/14*** | (2006.01) |

(52) U.S. Cl.

CPC ..... *H01J 35/065* (2013.01); *H01J 35/14* (2013.01)

USPC ..... 378/122; 378/136; 250/493.1

(58) Field of Classification Search

USPC ..... 378/119, 121, 122, 136–138, 210; 250/423 F, 493.1, 526; 313/346 R, 313/495–497, 308–311, 351, 336; 315/291, 315/167, 169.1, 169.3; 345/74.1, 75.2

See application file for complete search history.

(56) References Cited

U.S. PATENT DOCUMENTS

2012/0257723 A1* 10/2012 Kim et al. ..... 378/138

FOREIGN PATENT DOCUMENTS

KR 10-0711186 B1 4/2007
KR 10-2009-0065108 A 6/2009

* cited by examiner

*Primary Examiner* — Anastasia Midkiff
(74) *Attorney, Agent, or Firm* — Rabin & Berdo, P.C.

(57) ABSTRACT

The present disclosure relates to a field emission X-ray tube apparatus for facilitating cathode replacement, and more particularly, to a field emission X-ray tube apparatus for facilitating cathode replacement in which gates and cathodes are easily arranged through a joining member and a rotation preventing guide when gates and insulating spacers are rotated and joined with the cathodes while the cathodes and respective gates maintain electrical insulation, thereby easily replacing the cathodes.

6 Claims, 9 Drawing Sheets

FIELD EMISSION X-RAY TUBE APPARATUS FOR FACILITATING CATHODE REPLACEMENT

CROSS-REFERENCE TO RELATED APPLICATIONS

This application is based on and claims priority from Korean Patent Application No. 10-2011-0027942, filed on Mar. 29, 2011 and Korean Patent Application No. 10-2011-0134553, filed on Dec. 14, 2011, with the Korean Intellectual Property Office, the present disclosure of which is incorporated herein in its entirety by reference.

TECHNICAL FIELD

The present disclosure relates to a field emission X-ray tube apparatus for facilitating cathode replacement, and more particularly, to a field emission X-ray tube apparatus for facilitating cathode replacement in which gates and cathodes are easily arranged through a joining member and a rotation preventing guide when gates and insulating spacers are joined with the cathodes while the cathodes and respective gates maintain electrical insulation, thereby easily replacing the cathodes.

BACKGROUND

A general X-ray tube generates X-rays by allowing electrons to collide with a metallic anode target with high energy. For example, the X-ray tube uses a generation principle of Bremstralung X-rays or predetermined X-rays generated according to a material of an anode target. Herein, an electron source emitting electrons is generally a thermal electron source.

Meanwhile, an X-ray tube emitting electrons by using nano materials is provided. The X-ray tube uses a field-emission emitter. In the case of the X-ray tube, it is important to apply nano materials, which are effective for field emission, to a cathode electrode, form a gate electrode in order to apply an electric field to the nano materials, and seal each structure of the X-ray tube in a vacuum.

A field emission source has a structure to use electrons emitted from materials by a tunneling effect when the electric field is applied to the emitter, unlike the thermal electron source. A general structure of a field emission source uses a principle in which the electric field is applied to the emitter on the cathode by voltage applied between the cathode and the gate by inserting between the anode and the cathode one or more gate electrodes having a grid or one or more gate holes on the emitter. The plurality of gates are additionally installed between the gate and the anode in addition to a gate inducing field emission to be used to appropriately control a trajectory of an emitted electron beam. When the gate electrode is used as a mesh, it is advantageous in that the emitter and the gate holes do not need to be aligned, but gate current that leaks through the gate holes cannot be prevented.

In order to remove the leakage, the gate holes are aligned according to an emitter pattern and the gate holes need to be maintained at a regular interval. When the field emission source is formed in a large pattern, it is advantageous that the gate holes are aligned in the emitter pattern, but a distance between the gate electrode and the emitter increases. Therefore, it is disadvantageous in that higher voltage is applied to the gate electrode in order to acquire the same field-emission current. That is, when the emitter and the gate holes are formed largely to be aligned by visual inspection, it is easy to manufacture the X-ray tube, but it is disadvantageous in that sufficient field emission occurs only by applying high voltage to the gate.

On the contrary, when the emitter pattern is formed as an array to be smaller and the gate holes are also formed as an array according to the emitter pattern, the cathode and the gate are installed to be closer to each other, thereby reducing gate voltage. That is, in order to reduce voltage applied to the gate, a field-emission emitter is patterned in a small dot array pattern and when the emitter pattern is aligned with gate holes having slightly larger sizes, field emission may occur even at low gate voltage. However, in this case, it is difficult to align the gate holes and the emitter pattern due to the downsized emitter pattern, and as a result, it is difficult to manufacture the X-ray tube. That is, the alignment of the gate holes and the emitter may not be distinguished by visual inspection, and as a result, it is not easy to manufacture the X-ray tube. The gate electrode and the cathode electrode with the emitter need to be insulated from each other while maintaining a predetermined distance. It is not easy to join the gate electrode and the cathode electrode by using a material having small out-gassing which is easily vacuum-sealed with an alignment degree of approximately hundreds of micrometers.

Meanwhile, the X-ray tube using the field-emission emitter should include various electrodes including the gate electrode, the emitter electrode, an anode electrode, and the cathode electrode. The size of the X-ray tube increases due to various electrodes, and as a result, miniaturization is difficult.

SUMMARY

The present disclosure has been made in an effort to provide a field-emission X-ray tube apparatus for facilitating cathode replacement in which gates and cathodes are easily arranged through a joining member and a rotation preventing guide when gates and insulating spacers are joined with the cathodes while the cathodes and respective gates maintain electrical insulation, thereby easily joining/replacing the cathodes.

An exemplary embodiment of the present disclosure provides a field-emission X-ray tube apparatus, including: a cathode emitting electrons through a field-emission emitter; gates applying an electric field to the field-emission emitter through a gate electrode with gate holes; a plurality of additional gates controlling a trajectory of an emitted electron beam; an anode in which the emitted electros collide with each other to generate an X-ray; and a rotation preventing guide preventing the cathode and the plurality of gates from being misaligned due to rotation even when the cathode and the gates are rotated by a joining member while the cathode and the gates are joined to each other by using the joining member and insulating spacers are inserted among the joining member, the cathode, and the gate to maintain electrical insulation among the joining member, the cathode, and the gate.

According to exemplary embodiments of the present disclosure, a cathode with a field-emission emitter and a gate with gate holes can be joined so as to be insulated from each other while easily aligning the gate holes and a pattern of the field-emission emitter.

When cathode replacement is required, the cathode can be easily replaced through an inserted O-ring.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Figure 1:
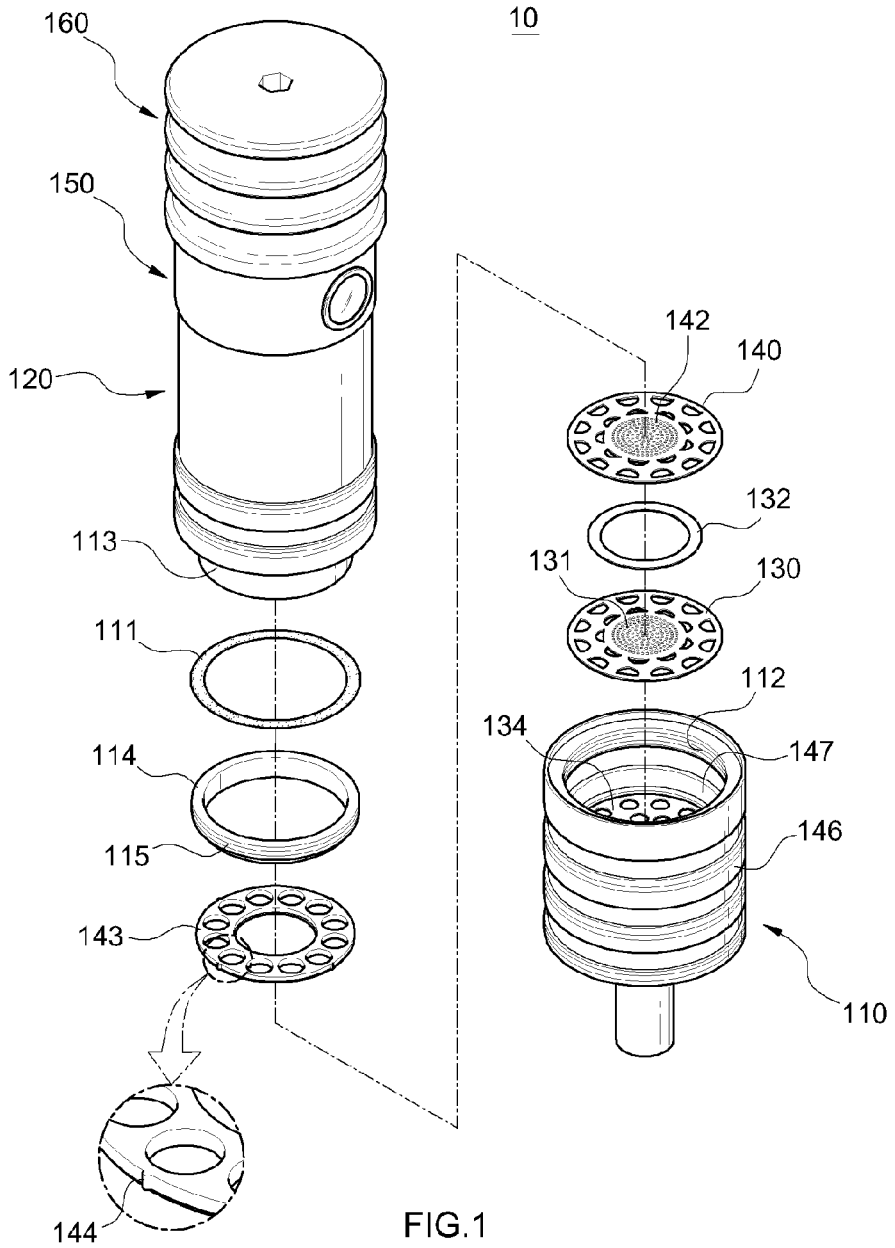
FIG. 1 is an assembly diagram of a field-emission X-ray tube apparatus for facilitating cathode replacement according to an exemplary embodiment of the present disclosure.

FIG. 1 is an assembly diagram of a field-emission X-ray tube apparatus for facilitating cathode replacement according to an exemplary embodiment of the present disclosure.

As shown in FIG. 1, an X-ray tube apparatus 10 according to an exemplary embodiment of the present disclosure includes an exhaust unit 110, a cathode 130 including a field-emission emitter 131 formed on a cathode substrate, an insulating spacer 132, a gate 140 with gate holes 142, a fixation screw 114, a gate external electrode 146 including a female screw 147, an X-ray withdrawing unit 150, and an anode 160. Herein, the cathode 130 includes a cathode external electrode 134. The gate 140 includes a cover 143 with a male projection 144. The fixation screw 114 is an example of a fixing device that fixes the cathode 130, the insulating spacer 132, and the gate 140 to each other and is not limited to the fixation screw.

Hereinafter, the respective components of the field-emission X-ray tube apparatus for facilitating cathode replacement according to the exemplary embodiment of the present disclosure will be described.

The exhaust unit 110 serves to extract air in a tube. For example, an exhaust tube 111 may be configured by a glass tube or an anaerobic copper tube which can be pinched off.

Electrons are emitted from the field-emission emitter 131 formed on the cathode 130 substrate.

The insulating spacer 132 is inserted between the cathode 130 and the gate 140 to maintain a predetermined distance therebetween to maintain electrical insulation between the cathode 130 and the gate 140 with the gate holes 142.

An electric field is applied to the field-emission emitter 131 through the gate 140 electrode with the gate holes 142. In order to apply the electric field to the gate 140, when voltage is applied to the gate external electrode 146 from the outside of the tube, the gate external electrode 146 is electrically connected to the gate 140 through the fixation screw 114 fixed to the female screw 147 of the gate external electrode 146 with a male screw 115 and the cover 143, and as a result, voltage is applied to the gate 140. In this case, when cathode voltage is applied to the cathode 130 through the cathode external electrode 134 from the outside of the tube, the gate 140 and the cathode 130 are electrically insulated from each other by the insulating spacer 132.

A convergent electrode 120 converges electrons generated from the cathode 130. As one example, the convergent electrode 120 may include primary and secondary convergent electrodes.

The fixation screw 114 may include the male screw 115 and presses the cover 143 in a screwing direction to fix the cathode 130, the insulating spacer 132, and the gate 140 to each other. In this case, the cover 143 may move only in the screwing direction without rotating by engaging with a female projection 145 formed at the gate external electrode 146 by the male projection 144.

The X-ray withdrawing unit 150 withdraws X-rays generated from the anode 160 to the outside through a window.

In the anode 160, the electrons converged by the convergent electrode 120 collide with an anode target to generate the X-rays. Herein, the anode target may be made of tungsten or molybdenum.

Meanwhile, a female screw 112 is provided on the top of the exhaust unit 110 and a male screw 113 is provided on the bottom of the convergent electrode 120. An O-ring 111 is inserted between the male screw 112 and the female screw 113 to join the convergent electrode 120 and the exhaust unit 110 to each other. The O-ring 111 facilitates removal or replacement of the damaged cathode 130 while maintaining a sealing state of the X-ray tube apparatus 10. Herein, the exhaust unit 110 and the convergent electrode 120 are used as an external vacuum container and can be vacuum-joined to each other by the O-ring.

Figure 2:
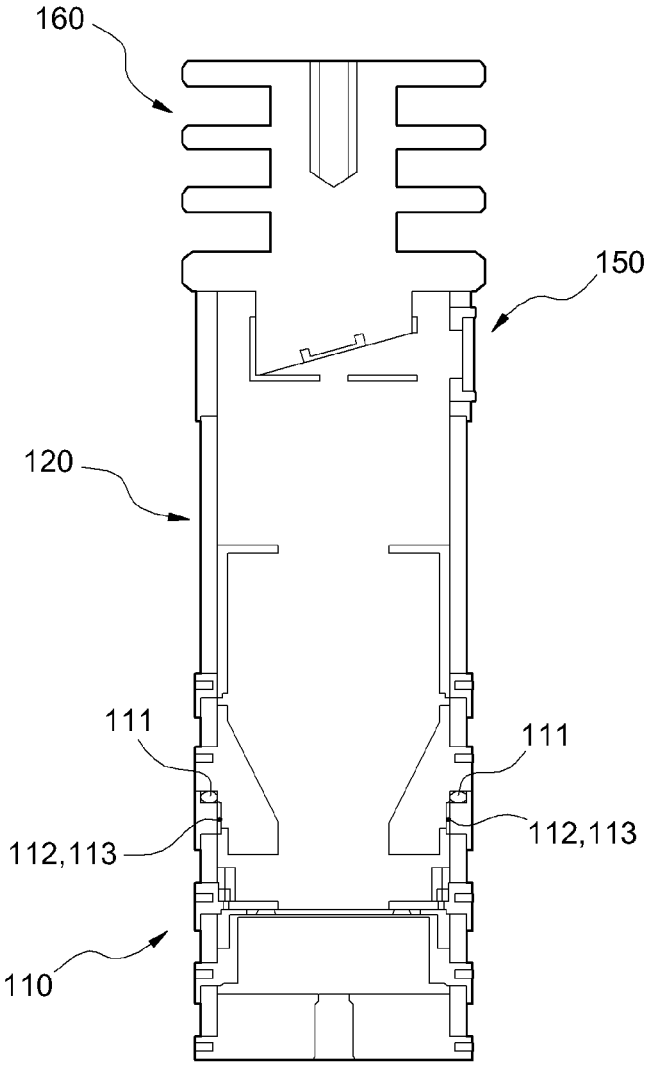
FIG. 2 is a cross-sectional view of the field-emission X-ray tube apparatus for facilitating cathode replacement according to the exemplary embodiment of the present disclosure.

FIG. 2 is a cross-sectional view of the field-emission X-ray tube apparatus for facilitating cathode replacement according to the exemplary embodiment of the present disclosure.

An assembly structure of the components shown in FIG. 1, that is, a structure in which the exhaust unit 110, the cathode 130 including the field-emission emitter 131, the insulating spacer 132, the gate 140 with the gate holes 142, the fixation screw 114, the convergent electrode 120, the X-ray withdrawing unit 150, and the anode 160 are assembled is shown in FIG. 2.

Herein, in the exhaust unit 110 and the convergent electrode 120, the female screw 112 on the top and the male screw 113 on the bottom are joined to each other with the O-ring 111 inserted. The field-emission X-ray tube apparatus 10 may maintain the sealing state by the O-ring 111. The O-ring 111 may be used to easily remove the cathode 130 of the field-emission X-ray tube apparatus 10. That is, when the field-emission emitter 131 formed on the cathode 130 is damaged, the field-emission X-ray tube apparatus 10 can be sealed and joined through the O-ring 111 even after the damaged field-emission emitter 131 is removed. That is, when replacing the damaged cathode 130 with a new cathode, the O-ring 111 is inserted between the female screw 112 and the male screw 113 to easily join the female screw 112 and the male screw 113.

Figure 3:
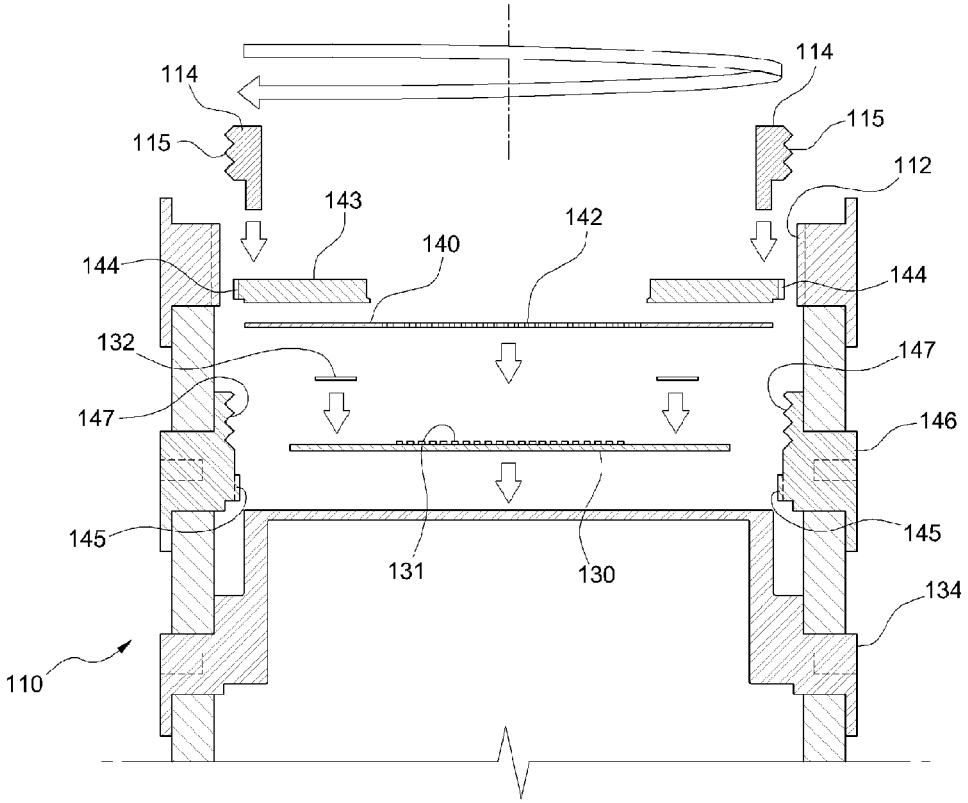
FIG. 3 is an explanatory diagram of a joining process between a cathode and a gate of the field-emission X-ray tube apparatus according to the exemplary embodiment of the present disclosure.

FIG. 3 is an explanatory diagram of a joining process between a cathode and a gate of the field-emission X-ray tube apparatus according to the exemplary embodiment of the present disclosure.

FIG. 3 shows the joining structure of the cathode 130 including the field-emission emitter 131 formed on the cathode substrate, the insulating spacer 132, the gate 140 with the gate holes 142, and the fixation screw 114 with the male screw 115. The joining process in the field-emission X-ray tube apparatus 10 will be described.

Specifically, the cathode 130 is formed on the cathode external electrode 134 serving as an external electrode of the field-emission X-ray tube apparatus 10.

The field-emission emitter 131 is formed on the cathode substrate of the cathode 130.

The insulating spacer 132 is inserted between the cathode 130 and the gate 140. The insulating spacer 132 may be inserted into an edge of the cathode substrate of the cathode 130 which is not in contact with the field-emission emitter 131 so that the cathode external electrode 134 maintains a predetermined distance from the cover 143. Herein, the cover 143 includes the male projection 144.

Thereafter, the gate 140 with the gate holes 142 is joined onto the insulating spacer 132.

The cover 143 is put on the gate 140 with the gate holes 142 and thereafter, the ring-shaped fixation screw 114 is inserted while rotating in an arrow direction. Thereafter, the emitter pattern of the field-emission emitter 131 and the gate holes 142 are aligned by using a microscope while the fixation screw 114 is slightly fixed so that the gate 140 and the cathode 130 may be aligned by slight friction. When the alignment is terminated, the ring-shaped fixation screw 114 is fully fixed to maintain the alignment. In this case, the male screw 115 of the fixation screw 114 is joined with the female screw 147 of the gate external electrode 146 to fix the gate 140 and the cathode 130. A distance between the gate 140 and the cathode 130 is determined by the thickness of the insulating spacer 132 positioned therebetween and insulation therebetween is maintained.

Even while the fixation screw 114 rotates, the male projection 144 provided in the cover 143 and the female projection 145 of the gate external electrode 146 engage with each other to be fixed to prevent the cover 143 from rotating. The emitter pattern of the field-emission emitter 131 and the gate holes 142 are prevented from being misaligned even while the fixation screw 114 rotates and presses the emitter pattern and the gate holes, due to the male projection 144 and the female projection 145.

FIGS. 4 to 9 are structural diagrams of respective components of the field-emission X-ray tube apparatus of FIG. 3 according to the exemplary embodiment of the present disclosure.

The cathode external electrode 134, the gate external electrode 146, the cathode 130 with the field-emission emitter 131, the gate 140 with the gate holes 142, the cover 143, and the fixation screw 114 are shown in FIGS. 4 to 9. Herein, exhaust holes 135, 133, 148, and 149 are formed in the cathode external electrode 134, the cathode 130, the gate 140, and the cover 143, respectively, and as a result, air freely flows into upper and lower parts of a structure. The holes are used for exhaustion to maintain a vacuum in the field-emission X-ray tube apparatus 10.

Figure 4:
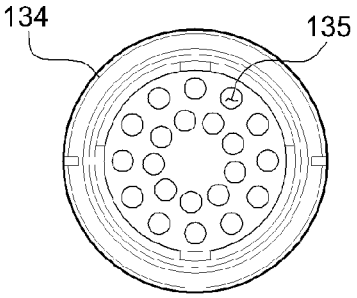
FIGS. 4 to 9 are structural diagrams of respective components of the field-emission X-ray tube apparatus of FIG. 3 according to the exemplary embodiment of the present disclosure.

Specifically, as shown in FIG. 4, the exhaust hole 135 is formed in the cathode external electrode 134.

Figure 5:
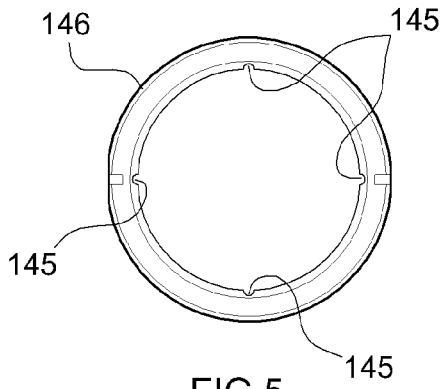

As shown in FIG. 5, the female projections 145 are formed at upper and lower and left and right portions of the gate external electrode 146. The female projection 145 of the gate external electrode 146 engages with the male projection 144 of the cover 143 to be fixed.

Figure 6:
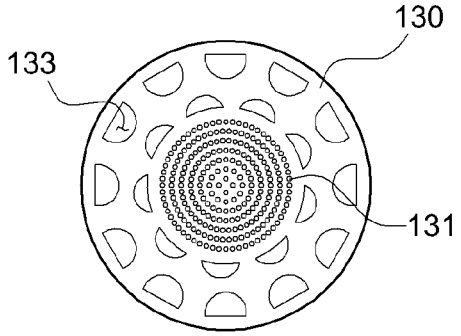

As shown in FIG. 6, the exhaust hole 133 is formed in the gate 140 with the field-emission emitter 131.

Figure 7:
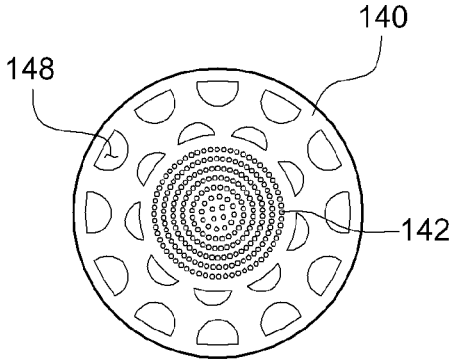

As shown in FIG. 7, the exhaust hole 148 is formed in the gate 140 with the gate holes 142. The gate holes 142 may be made of a thin metallic material so that small holes are easily formed.

Figure 8:
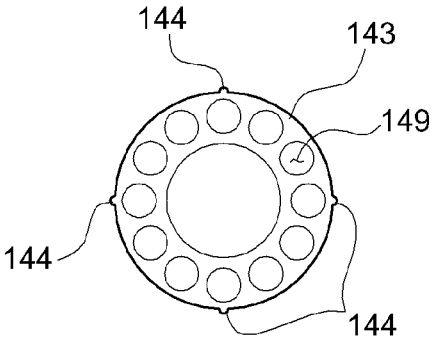

As shown in FIG. 8, the male projections 144 are formed at the upper and lower and left and right portions of the cover 143. The exhaust hole 149 is formed in the cover 143. Herein, the male projection 144 of the cover 143 is joined to the female projection 145 of the gate external electrode 146 to serve to fix the gate 130.

Figure 9:
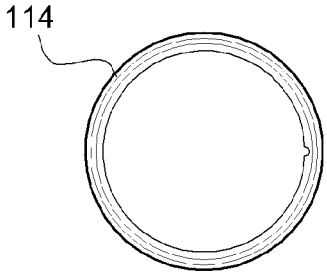

As shown in FIG. 9, the fixation screw 114 fixes the cover 143 serving as a pressing plate to maintain a predetermined thickness without bending.

Figure 10:
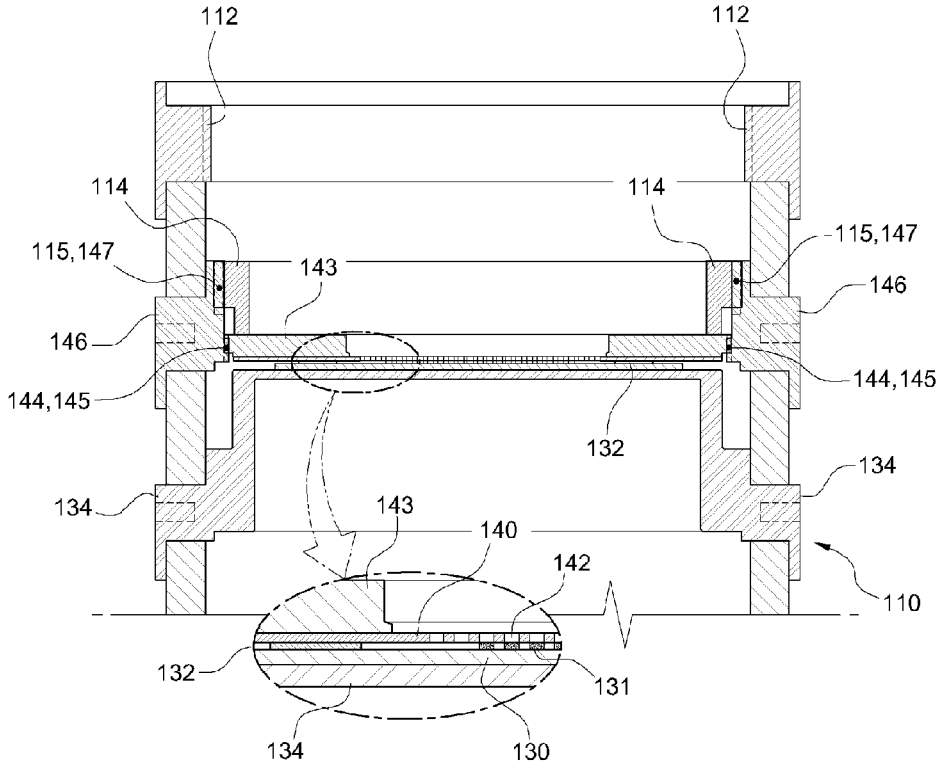
FIG. 10 is a cross-sectional view of the field-emission X-ray tube apparatus in which the cathode and the gate are joined to each other according to the exemplary embodiment of the present disclosure.

FIG. 10 is a cross-sectional view of the field-emission X-ray tube apparatus in which the cathode and the gate are joined to each other according to the exemplary embodiment of the present disclosure.

A structure of the field-emission X-ray tube apparatus 10 joined according to the joining process of the cathode 130 including the field-emission emitter 131 formed on the cathode substrate, the insulating spacer 132, the gate 140 with the gate holes 142, the cover 143, and the fixation screw 114 with the male screw 115, which is shown in FIG. 3, is shown.

The field-emission X-ray tube apparatus 10 in which the fixation of the cathode 130 and the gate 140 is completed is shown in FIG. 10. The distance between the gate 140 and the cathode 130 is determined by the thickness of the insulating spacer 132 positioned therebetween and insulation therebetween is maintained.

Figure 11:
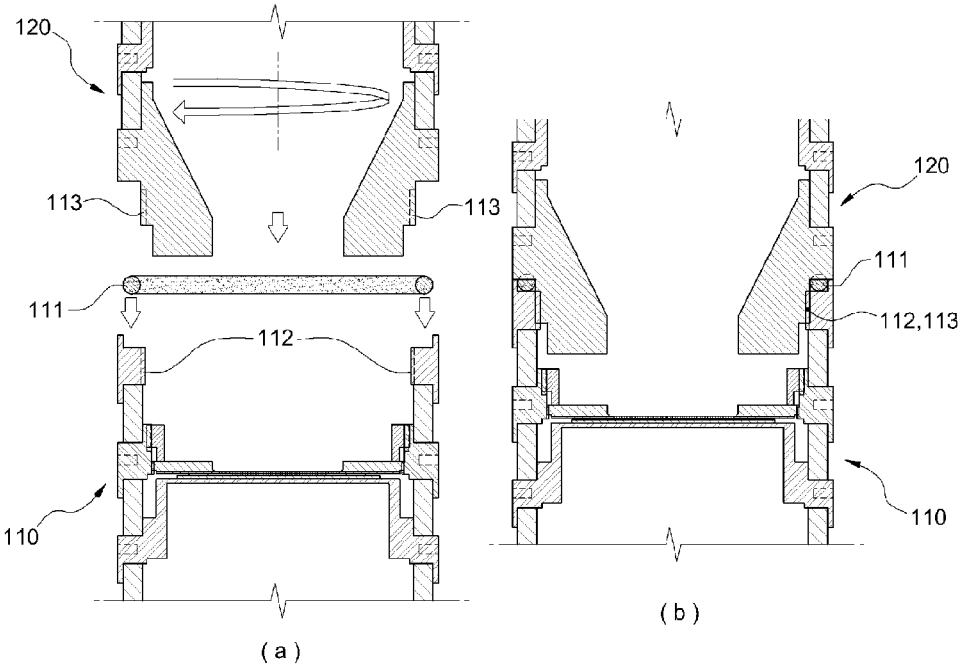
FIG. 11 is an explanatory diagram of a joining structure of the field-emission X-ray tube apparatus sealed by an O-ring according to the exemplary embodiment of the present disclosure.

FIG. 11 is an explanatory diagram of a joining structure of the field-emission X-ray tube apparatus sealed by an O-ring according to the exemplary embodiment of the present disclosure.

As shown in (a) of FIG. 11, the field-emission X-ray tube apparatus 10 may be joined in the sealing state by the O-ring 111. The field-emission X-ray tube apparatus 10 is joined in the sealing state and has a structure to easily remove and replace the damaged field-emission emitter 131. The male screw 113 positioned in the convergent electrode 120 on the top is joined to the female screw 112 positioned in the exhaust unit 110 on the bottom. The O-ring 111 is inserted therebetween. When the top of the convergent electrode 120 and the bottom of the exhaust unit 110 rotate in a rotating direction to be in close contact with each other by the male screw 113 and the female screw 112, vacuum close attachment can be achieved.

As shown in (b) of FIG. 11, the field-emission X-ray tube apparatus 10 is inserted with the O-ring 111 and is joined by the male screw 113 and the female screw 112.

If the cathode 130 is damaged while the field-emission X-ray tube apparatus 10 is driven, a joining portion of the O-ring 111 is removed and thereafter, the fixation screw 114 of the gate 130 is loosened.

A structure between the gate 130 and the cathode 130 is disassembled and the damaged cathode 130 is removed.

Thereafter, the new cathode 130 is remounted and then the field-emission X-ray tube apparatus 10 can be sealed again by using the O-ring 111.

Figure 12:
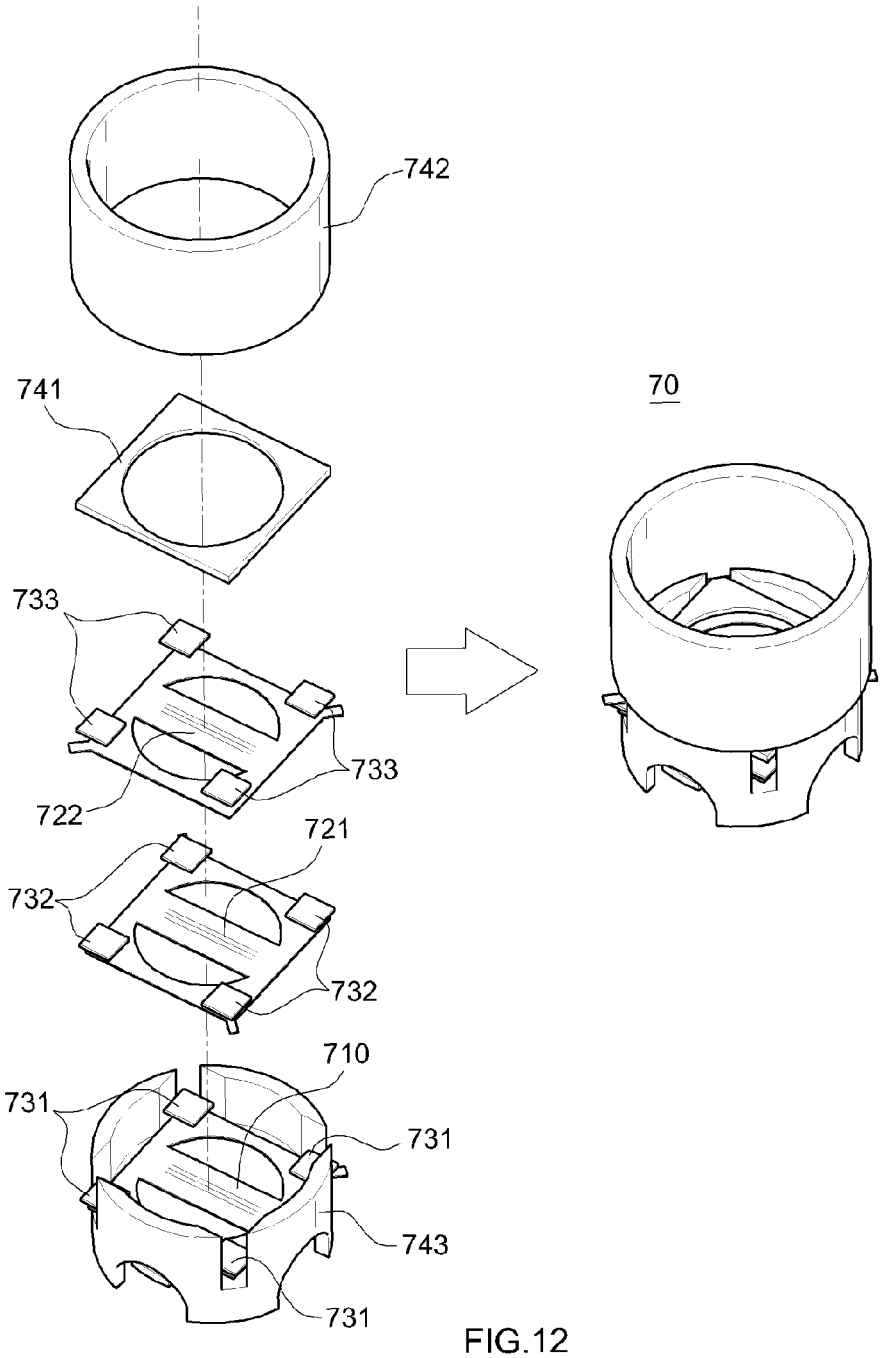
FIGS. 12 and 13 are an assembly diagram and an explanatory diagram of the field-emission X-ray tube apparatus for facilitating cathode replacement according to second exemplary embodiment of the present disclosure.
Figure 13:
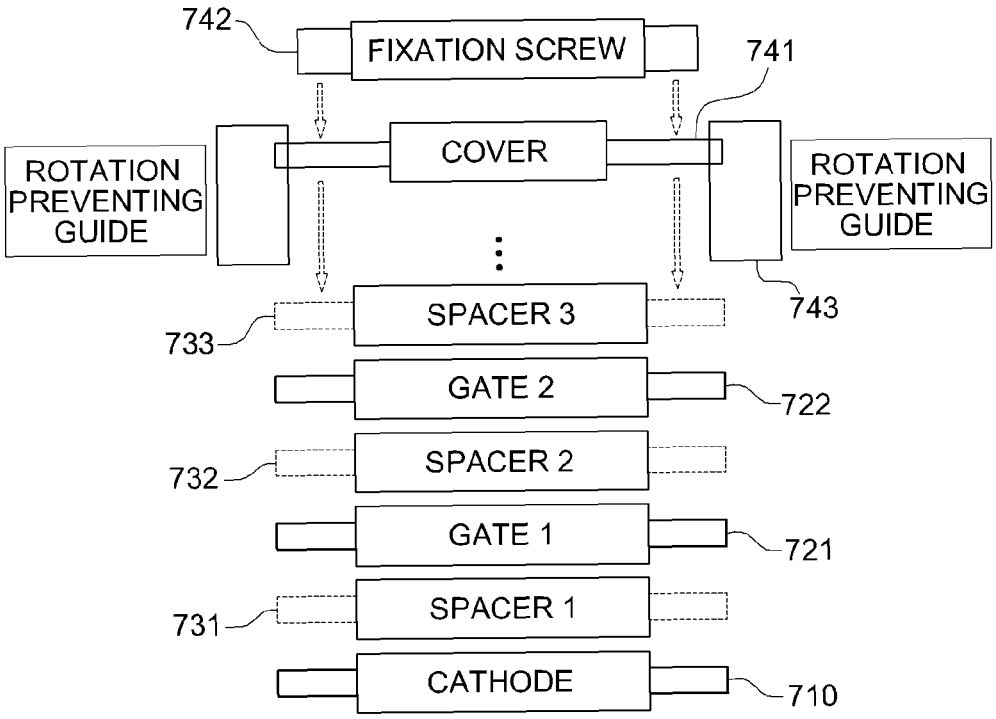

FIGS. 12 and 13 are an assembly diagram and an explanatory diagram of the field-emission X-ray tube apparatus for facilitating cathode replacement according to second exemplary embodiment of the present disclosure.

As shown in FIGS. 12 and 13, a field-emission X-ray tube apparatus 70 according to the second exemplary embodiment of the present disclosure includes a cathode 710, first and second gates 721 and 722, first through third insulating spacers 731 to 733, a cover 741, a fixation screw 742, and a rotation preventing guide 743.

Hereinafter, duplicated contents of the field-emission X-ray tube apparatus 70 according to the second exemplary embodiment of the present disclosure and the field-emission X-ray tube apparatus 10 according to the first exemplary embodiment of the present disclosure will be omitted and differences therebetween will be described. As compared with the first exemplary embodiment, the cathode, the gate, and the convergent electrode and an external vacuum tube joining structure by the O-ring of the second exemplary embodiment of the present disclosure are similar to those of the first exemplary embodiment, and thus will not be described.

The cathode 710, the first and second gates 721 and 722, the first through third insulating spacers 731 to 733, and the cover 741 may have polygonal shapes, not a circular shape of the first exemplary embodiment. As an example, the rectangular cathode 710, first and second gates 721 and 722, first through third insulating spacers 731 to 733, and cover 741 will be described.

The cathode 710 emits electrons through the field-emission emitter formed on the cathode substrate.

The first and second gates 721 and 722 apply the electric field to the field-emission emitter through the gate electrode with the gate holes.

The first insulating spacer 731 is inserted between the cathode 71 and the first gate 721 to maintain electrical insulation therebetween. The second insulating spacer 732 is inserted between the first gate 721 and the second gate 722 to maintain electrical insulation therebetween. The third insulating spacer 733 is inserted between the second gate 722 and the cover 741 to maintain electrical insulation therebetween. Although not clearly shown in FIGS. 12 and 13, an insulator is inserted between the cathode 71 and the rotation preventing guide 743, which are insulated from each other and angular points around the rectangular cathodes 710 are not in contact with the rotation preventing guide to maintain insulation.

The fixation screw 742 is constituted by a female screw and a male screw.

When the cathode 710, the first and second gates 721 and 722, the first through third insulating spacers 731 to 733, and the cover 741 are rectangular, each angular point of the rectangular engages with the rotation preventing guide 743, and as a result, the cathode 710, the first and second gates 721 and 722, the first through third insulating spacers 1 to 3 731 to 733, and the cover 741 do not rotate even when the fixation screw 742 rotates.

Gates and cathodes are easily arranged through a fixation screw and a rotation preventing guide when gates and insulating spacers are rotated and joined with the cathodes while the cathodes and respective gates maintain electrical insulation, thereby easily replacing the cathodes. From this point of view, as the present disclosure exceeds a limit of an existing technology, marketing or business possibility of an applied apparatus as well as only using an associated technology is sufficient and the present disclosure can be obviously worked, and thus, the present disclosure has industrial applicability.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A field-emission X-ray tube apparatus, comprising:

a cathode emitting electrons through a field-emission emitter;

at least one gate applying an electric field to the field-emission emitter through a gate electrode with gate holes or controlling a trajectory of a withdrawn electron beam;

an anode in which the emitted electrons collide with each other to generate an X-ray; and a rotation preventing guide preventing the cathode and the at least one gate from being misaligned due to rotation by a process of joining the cathode to the at least one gate;

wherein the cathode and the at least one gate are joined to each other by using a joining member.

2. The field-emission X-ray tube apparatus of claim 1, wherein at least one insulating spacer is inserted between the cathode and the at least one gate in order to maintain electrical insulation and a predetermined distance therebetween.

3. The field-emission X-ray tube apparatus of claim 1, wherein when the cathode and the at least one gate are fixed by using the joining member, a cover is inserted on top of the at least one gate.

4. The field-emission X-ray tube apparatus of claim 3, wherein a male projection provided in the cover and a female projection provided in the rotation preventing guide engage with each other.

5. The field-emission X-ray tube apparatus of claim 3, wherein when the cover has a polygonal shape, each angular point of a polygon engages with the rotation preventing guide.

6. The field-emission X-ray tube apparatus of claim 1, further comprising:

an external vacuum container separated into two parts constituted by a female screw and a male screw and closely attached in a vacuum state by inserting an O-ring between the female screw and the male screw.

* * * * *

UNITED STATES PATENT AND TRADEMARK OFFICE

CERTIFICATE OF CORRECTION

PATENT NO. : 8,942,352 B2
APPLICATION NO. : 13/406545
DATED : January 27, 2015
INVENTOR(S) : Jin Woo Jeong et al.

It is certified that error appears in the above-identified patent and that said Letters Patent is hereby corrected as shown below:

Title Page, Item 30 (Foreign Application Priority Data)

Please change the listing of Foreign Application Priority Data to read as follows:

-- Mar. 29, 2011 (KR) 10-2011-0027942
Dec. 14, 2011 (KR) 10-2011-0134553 --

Signed and Sealed this
Twenty-fifth Day of August, 2015

Michelle K. Lee

Michelle K. Lee
*Director of the United States Patent and Trademark Office*